US008313393B1

(12) United States Patent
Toxen

(10) Patent No.: US 8,313,393 B1
(45) Date of Patent: Nov. 20, 2012

(54) PUTTER WITH BALL MARKER

(75) Inventor: Richard W. Toxen, Inverness, FL (US)

(73) Assignee: Citrus County Association for Retarded Citizens, Inc., Lecanto, FL (US)

( * ) Notice: Subject to any disclaimer, the term of this patent is extended or adjusted under 35 U.S.C. 154(b) by 152 days.

(21) Appl. No.: 12/851,719

(22) Filed: Aug. 6, 2010

(51) Int. Cl.
*A63B 53/00* (2006.01)

(52) U.S. Cl. ..... 473/324; 473/285

(58) Field of Classification Search ..... 473/285, 473/324, 334, 335, 336, 337, 338, 340, 350, 473/406

See application file for complete search history.

(56) References Cited

U.S. PATENT DOCUMENTS

| | | | | |
|---|---|---|---|---|
| 3,595,582 | A | 7/1971 | Chapman | |
| 3,749,408 | A | 7/1973 | Mills | |
| 4,017,082 | A * | 4/1977 | Channing et al. | 473/285 |
| 5,417,426 | A * | 5/1995 | Bayer | 473/285 |
| 5,492,329 | A * | 2/1996 | Kronin | 473/220 |
| 5,605,510 | A | 2/1997 | Schmidt | |
| 5,972,144 | A | 10/1999 | Hsu | |
| 6,200,226 | B1 * | 3/2001 | Regan | 473/223 |
| 6,425,831 | B1 * | 7/2002 | Heene et al. | 473/332 |
| 6,692,376 | B2 | 2/2004 | Kosovac | |
| 6,729,972 | B2 | 5/2004 | Boord | |
| 6,878,071 | B1 * | 4/2005 | Schwieger et al. | 473/284 |
| 7,059,971 | B1 | 6/2006 | Schmitt | |
| 7,172,517 | B1 | 2/2007 | Phelps | |
| 7,510,484 | B2 | 3/2009 | Tavares | |
| 7,749,105 | B2 | 7/2010 | Zielke | |
| 2002/0022532 | A1 * | 2/2002 | Tucker, Sr. | 473/288 |
| 2002/0147055 | A1 | 10/2002 | French | |
| 2003/0153400 | A1 | 8/2003 | Boord | |
| 2004/0038746 | A1 | 2/2004 | Wahl | |
| 2005/0221908 | A1 | 10/2005 | Gornall | |
| 2006/0122004 | A1 * | 6/2006 | Chen et al. | 473/335 |
| 2007/0135232 | A1 * | 6/2007 | Billings | 473/340 |
| 2007/0191131 | A1 | 8/2007 | Nickel | |
| 2009/0029800 | A1 | 1/2009 | Jones | |
| 2010/0087269 | A1 | 4/2010 | Snyder | |
| 2010/0113182 | A1 | 5/2010 | Franklin | |

* cited by examiner

*Primary Examiner* — Gene Kim
*Assistant Examiner* — John E Simms, Jr.
(74) *Attorney, Agent, or Firm* — Brian S. Steinberger; Law Offices of Brian S. Steinberger, P.A.

(57) ABSTRACT

Devices, apparatus, and methods of storing and releasing a ball marker from the bottom of a head of the golf club, such as a putter. A compartment in the bottom of the golf club head has a side opening adjacent to the rear of the golf club head for allowing a disc shaped ball marker to be slid into the compartment, and sliding the marker in reverse allows the marker to be slid out of and removed from the compartment. A magnet can also be used. Also, the compartment can have grooved side walls that act as tracks to allow the marker to be slid into and out of the compartment. A removable top disc and front plate on the golf club head allows for advertising indicia and logos to be placed on the head of the golf club.

11 Claims, 16 Drawing Sheets

PUTTER WITH BALL MARKER

This invention relates to golf, in particular to devices, apparatus, and methods of storing and releasing a ball marker on a putter head.

BACKGROUND AND PRIOR ART

Golf is an extremely popular game where the players are constantly playing up to 18 holes per game usually with other players. A common problem occurs when more than one player is ready to make the final shot. Typically, these short shots require the use of a putter. When multiple parties are playing, it is normal for the players to pick up their balls until they are ready to take their turn. However, picking up the ball can create a problem if the player is not able to place the ball back in the exact spot from which it needs to be played. Markers such as a metal disc or coins are sometimes used to mark the player's spot until the player is ready. However, many players do not try to carry loose items on their person to use with marking the spot on the ground for the ball.

Various types of markers with golf clubs have been proposed over the years. See for example, U.S. Pat. Nos. 3,595,582 to Chapman; 3,749,408 to Mills; 4,017,082 to Channing et al.; 5,417,426 to Bayer; 5,605,510 to Schmidt et al.; 5,972,144 to Hsu; 6,200,226 to Regan; 6,425,831 to Heene et al.; 6,692,376 to Kosovac et al.; 6,729,972 to Boord; 7,059,971 to Schmitt; 7,172,517 to Phelps et al.; 7,510,484 to Tavares et al.; 7,749,105 to Zielke et al. and U.S. Patent Application Publications: 2002/0147055 to French; 2003/0153400 to Boord; 2004/0038746 to Wahl et al.; 2005/0221908 to Gornall; 2007/0191131 to Nickel; 2009/0029800 to Jones et al.; 2010/0087269 to Snyder et al.; 2010/0113182 to Franklin et al.

While some of the references show markers, the references primarily generally the markers be placed on the upper surface of the putter close to one of the sides of the putter. This non-central placement location would mean that the extra weight of the marker can potentially effect the use the putter by changing the balance of the putter head during play. Also, the upper locations may allow for accidental releases of the marker before, after or during play. Additionally, cut-outs in the top of the putter can detract from the appearance of the smooth lines and surfaces on the putter, and create an unaesthetic effect. Some of the references require openings on both the top and bottom of the putter to access the markers. Additionally, the references generally require the use of magnets which means that non-metal markers would not be able to stored. Thus, many of these attempted solutions create other problems to the player. Thus, the need exists for solutions to the above problems with the prior art.

SUMMARY OF THE INVENTION

A primary objective of the present invention is to provide devices, apparatus, and methods of storing and releasing a ball marker on a putter head having a marker storage compartment close to the center of mass of the putter head thereby not offsetting the balance of the putter head during play.

A secondary objective of the present invention is to provide devices, apparatus, and methods of storing and releasing a ball marker on a putter head, wherein the marker can easily be slid along the bottom of the putter into a storage location, and easily retrieved by sliding the marker out of the storage location underneath the putter.

A third objective of the present invention is to provide devices, apparatus, and methods of storing and releasing a ball marker on a putter head having a storage compartment that is not visibly located on or is accessible through the top of the putter.

A fourth objective of the present invention is to provide devices, apparatus, and methods of storing and releasing a ball marker on a putter head, wherein a metal marker can be held in place by a permanent magnet.

A fifth objective of the present invention is to provide devices, apparatus, and methods of storing and releasing a ball marker on a putter head, wherein metal and nonmetal markers can be held in place through track shaped side walls with friction.

A sixth objective of the present invention is to provide devices, apparatus, and methods of storing and releasing a ball marker on a putter head, wherein markers can be held in place through track shaped side walls with friction with permanent magnets.

A preferred embodiment of the golf club with compartment for holding a ball marker can include a head of a golf club having a bottom side, a top side, and front side, rear side, left side and right side, a longitudinal compartment in the bottom side of the golf club head, the compartment having a opening through the rear side of the head adjacent to the bottom, and the compartment having closed side walls, a closed upper wall, and an opening in a lower wall of the compartment through the bottom side of the golf club head, and a ball marker that is slid into and out of the opening in the rear side of the gulf club head into the compartment, so that the ball marker is held within the compartment. The golf club can be a putter.

The longitudinal compartment can be oblong shaped and is located under a center of gravity of the golf club head. A magnet can be located adjacent to the closed upper wall of the compartment for holding the marker in the compartment.

An alternative compartment can include track slots, such as a T-shaped slot along the side walls of the compartment for allowing edges of the marker to slide therein by friction between the edges of the marker and the track slots in side walls of the compartment.

Also, a magnet can be located adjacent to the closed upper wall of the compartment for holding the marker in the compartment, along with the track slots along the side walls of the compartment for allowing edges of the marker to slide therein.

The golf club can include an opening in the top side of the head for placing removable plate with indicia. A removable circular disc as the plate can have an upper surface for the indicia. Alternatively, a removable rectangular plate having an upper surface for the indicia.

The upper removable plate can be metal and can be held in place by another magnet for attaching the removable indicia plate to the opening in the top side of the head.

The golf club can also have a surface on the front side of the golf club head for placing a removable indicia plate thereon. Another magnet can be used for attaching the removable metal indicial plate thereon.

In a preferred embodiment, the ball marker can be metal and is held in place by the permanent magnet on the bottom side of the head. Also, a nonmetal marker, such as a plastic marker can be held in place by the T-slot shaped cavity.

Further objects and advantages of this invention will be apparent from the following detailed description of the presently preferred embodiments which are illustrated schematically in the accompanying drawings.

DESCRIPTION OF THE PREFERRED EMBODIMENTS

Figure 2:
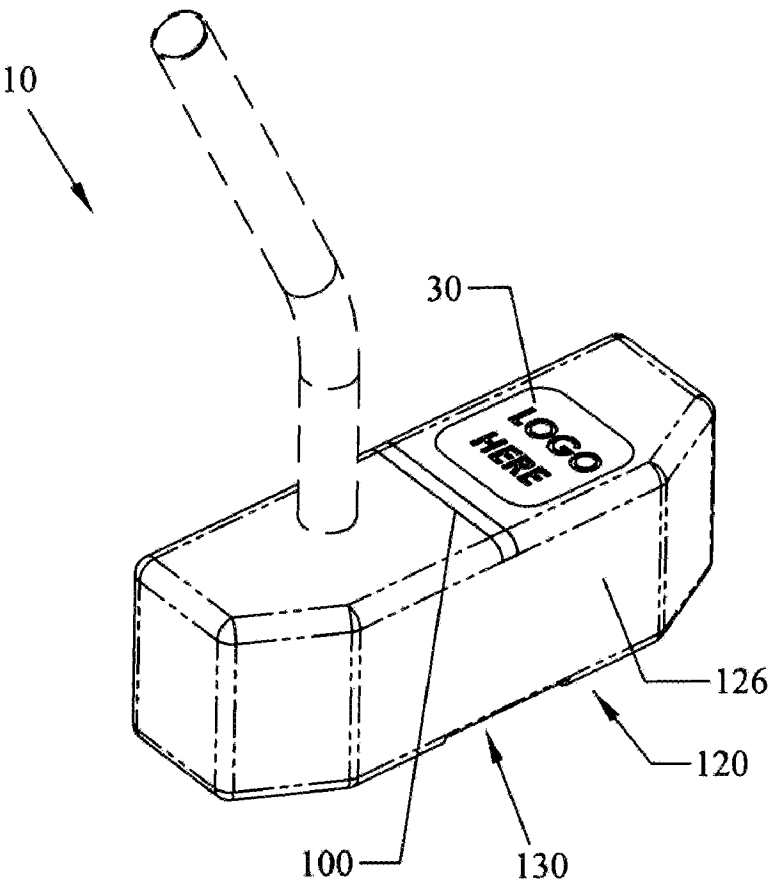
FIG. 2 is a top rear perspective view of the putter head of FIG. 1.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A components will now be described.

10. Putter head with cavity and magnet for ball marker. Square logo plate shown.
20. Putter head with slot and magnet for ball marker. Round logo plate shown.
30. Square logo plate.
40. Round logo plate.
50. Ball marker.
60. Lead weight.
65. Optional magnet on front face of weight
70. Magnet to retain ball marker.
80. Advertising plate covers lead weight.
90. Putter shaft (prior art).
100. Sight line.
110. T-slot for ball marker.
120. Body of putter head.
122. Bottom of putter head.
126. Rear(back) of putter head.
128. Front face of putter head
130. Cavity for ball marker.
132. side opening to cavity through lower rear wall of putter head 120
138. closed sidewalls of cavity
140. Cavity for lead weight.
150. Cavity for square logo plate.
155. Optional magnet in cavity 150
160. Cavity for round logo plate.
170. Cavity for magnet.
180. Hole for shaft.

Slidable Magneticaly Held Marker

Figure 1:
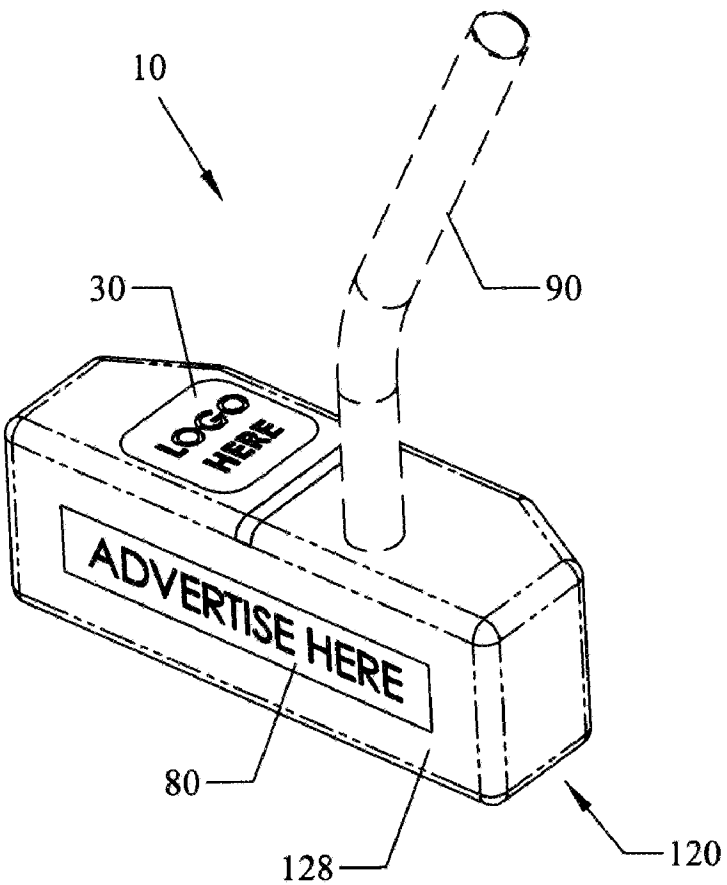
FIG. 1 is a top front perspective view of the novel putter head.
Figure 4:
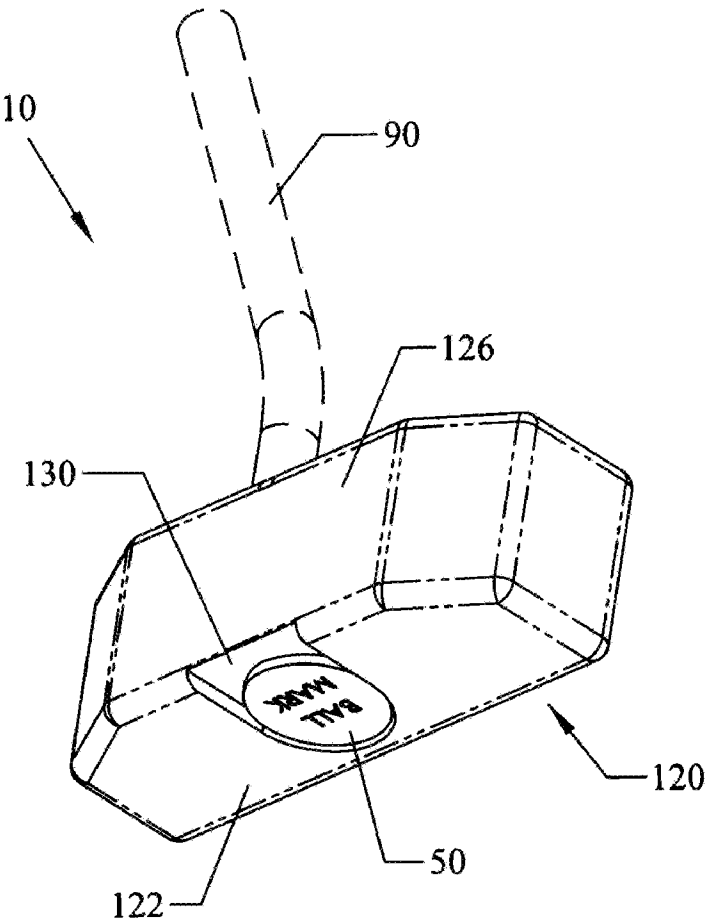
FIG. 4 is a bottom rear perspective view of the putter head of FIG. 1.
Figure 3:
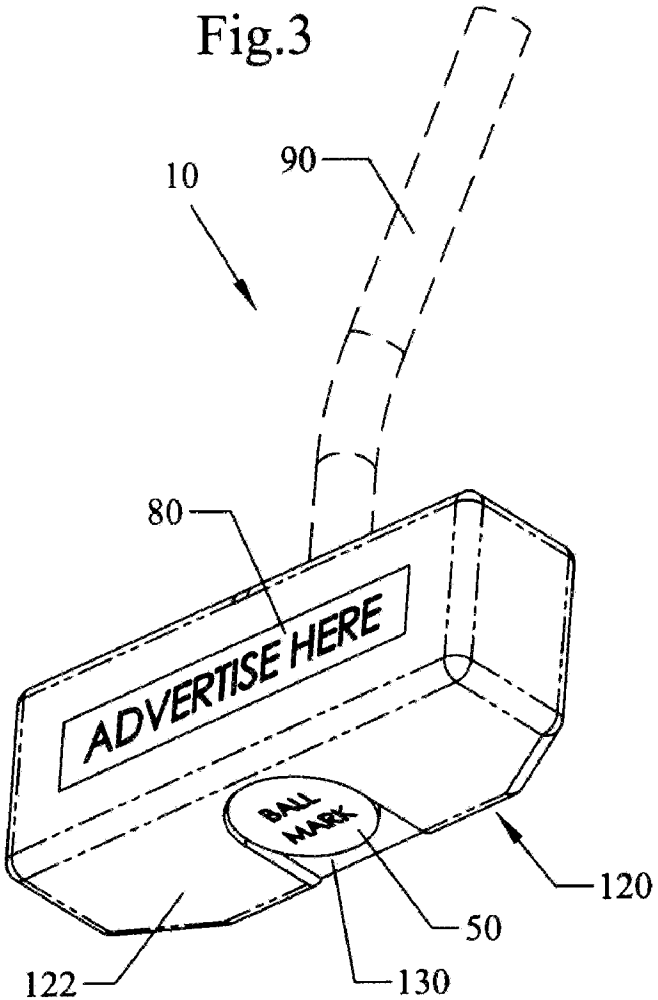
FIG. 3 is a bottom front perspective view of the putter head of FIG. 1.
Figure 5:
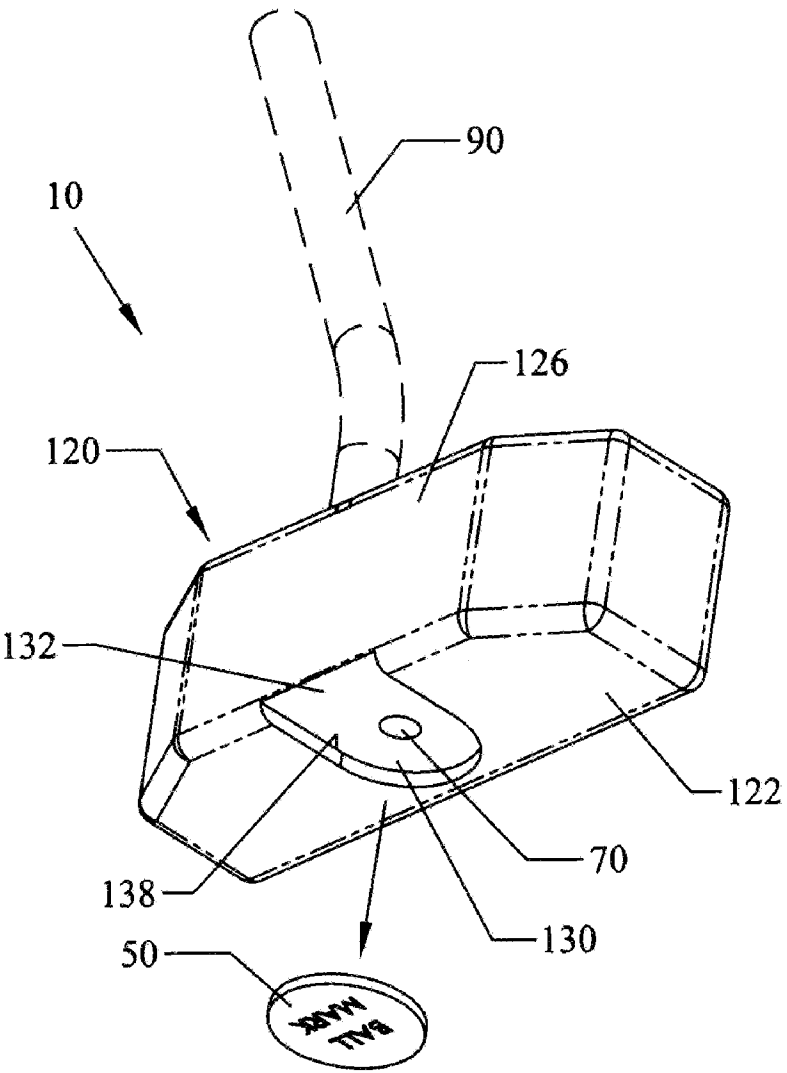
FIG. 5 is a bottom rear perspective view of the putter head of FIG. 1 with ball marker removed.
Figure 7:
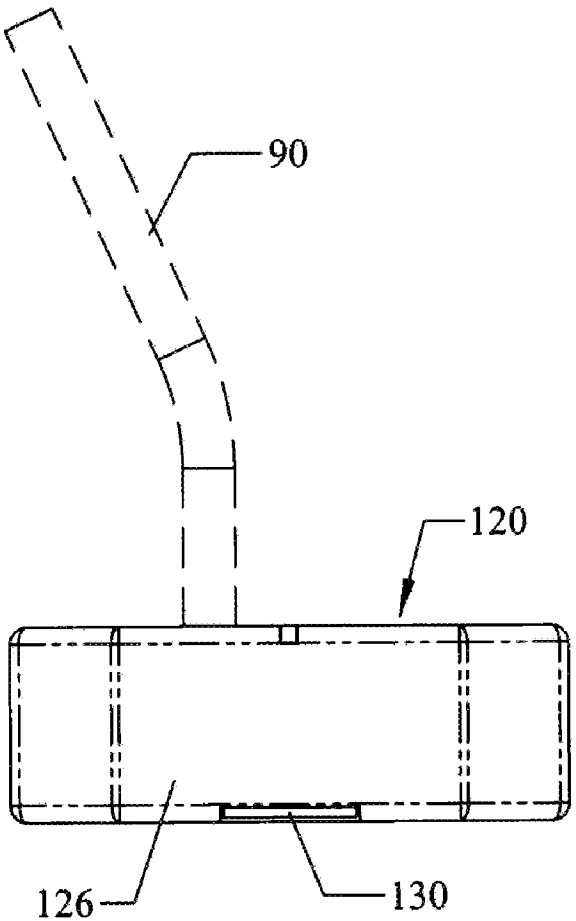
FIG. 7 is a rear side view of the putter head of FIG. 1.
Figure 6:
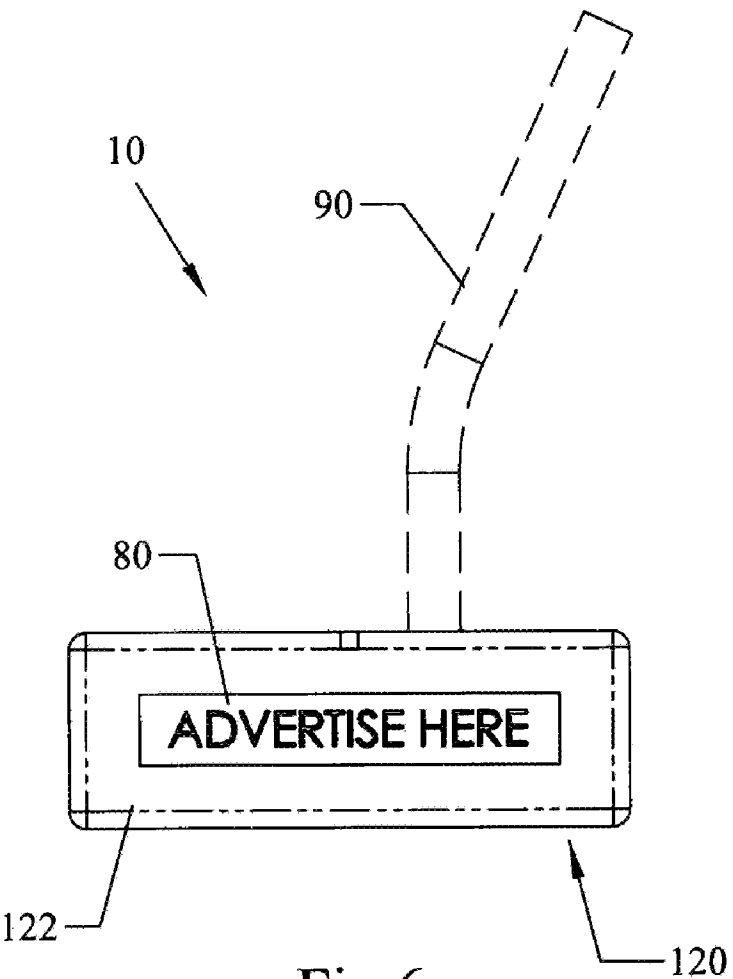
FIG. 6 is a front side view of the putter head of FIG. 1.
Figure 9:
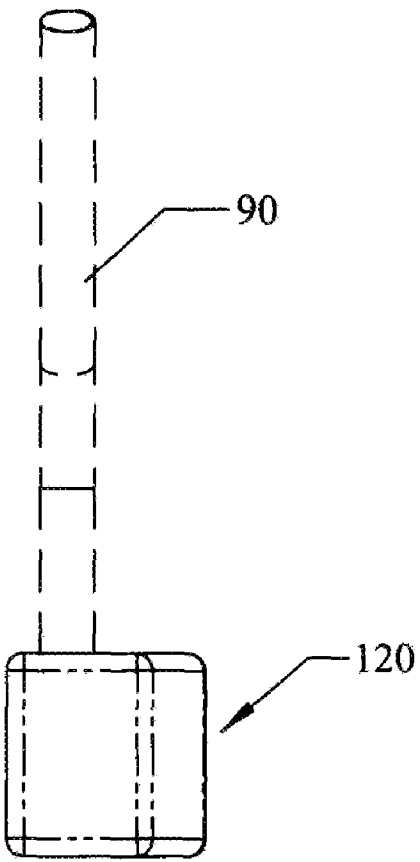
FIG. 9 is a left side view of the putter head of FIG. 1.
Figure 8:
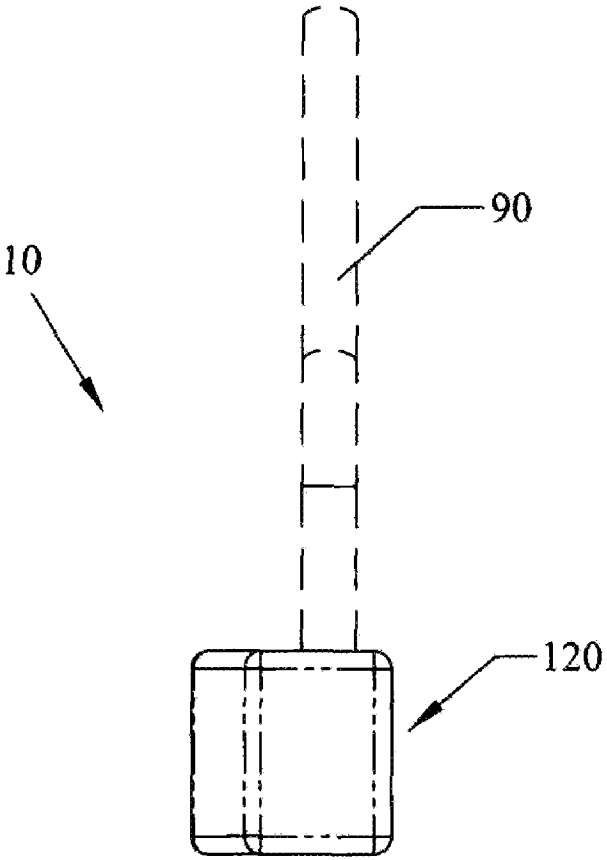
FIG. 8 is a right side view of the putter head of FIG. 1.
Figure 10:
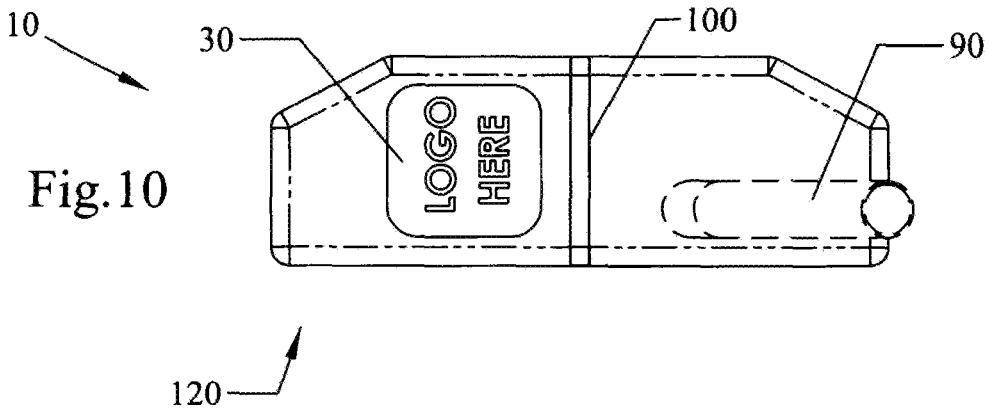
FIG. 10 is a top side view of the putter head of FIG. 1.
Figure 11:
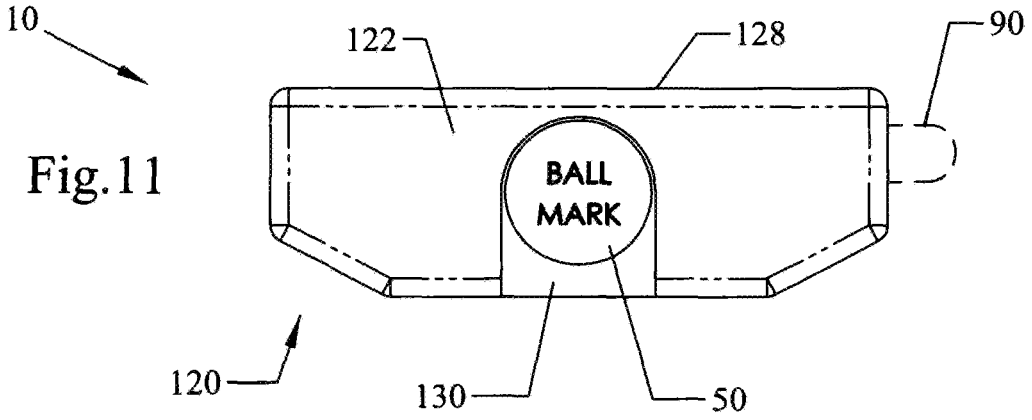
FIG. 11 is a bottom side view of the putter head of FIG. 1 with ball marker in place.
Figure 12:
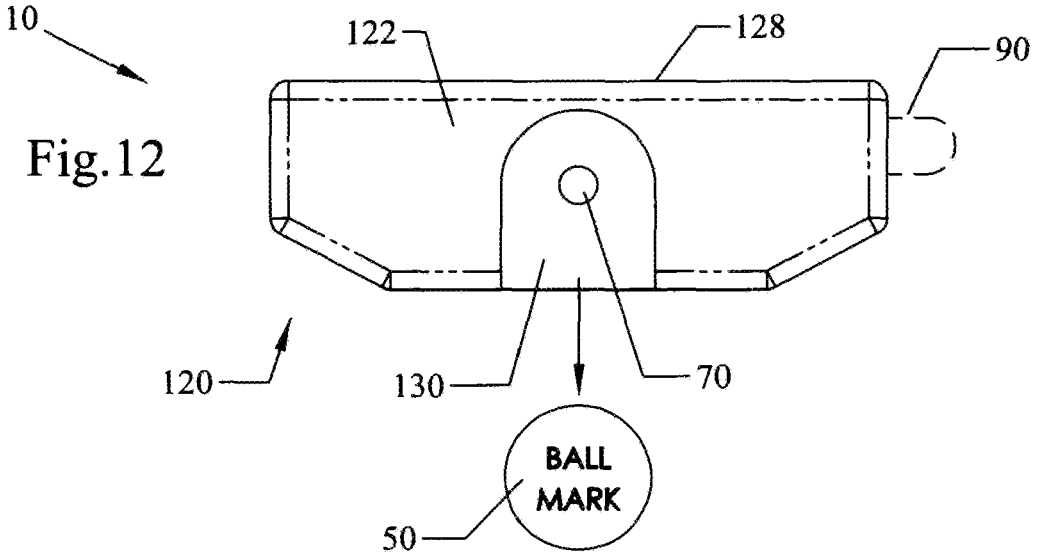
FIG. 12 is another bottom view of the putter head of FIG. 11 with ball marker removed.
Figure 13:
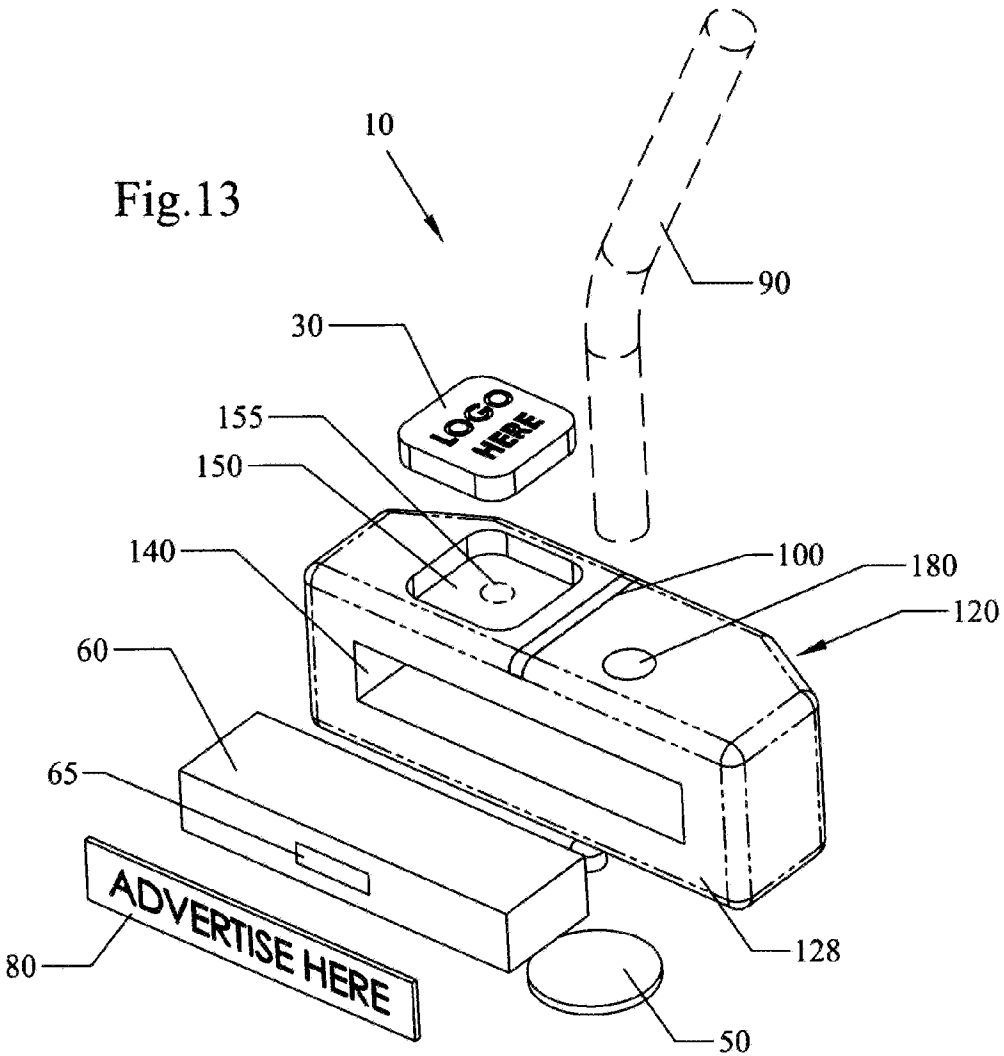
FIG. 13 is a top front exploded perspective view of the putter head of FIG. 1.
Figure 14:
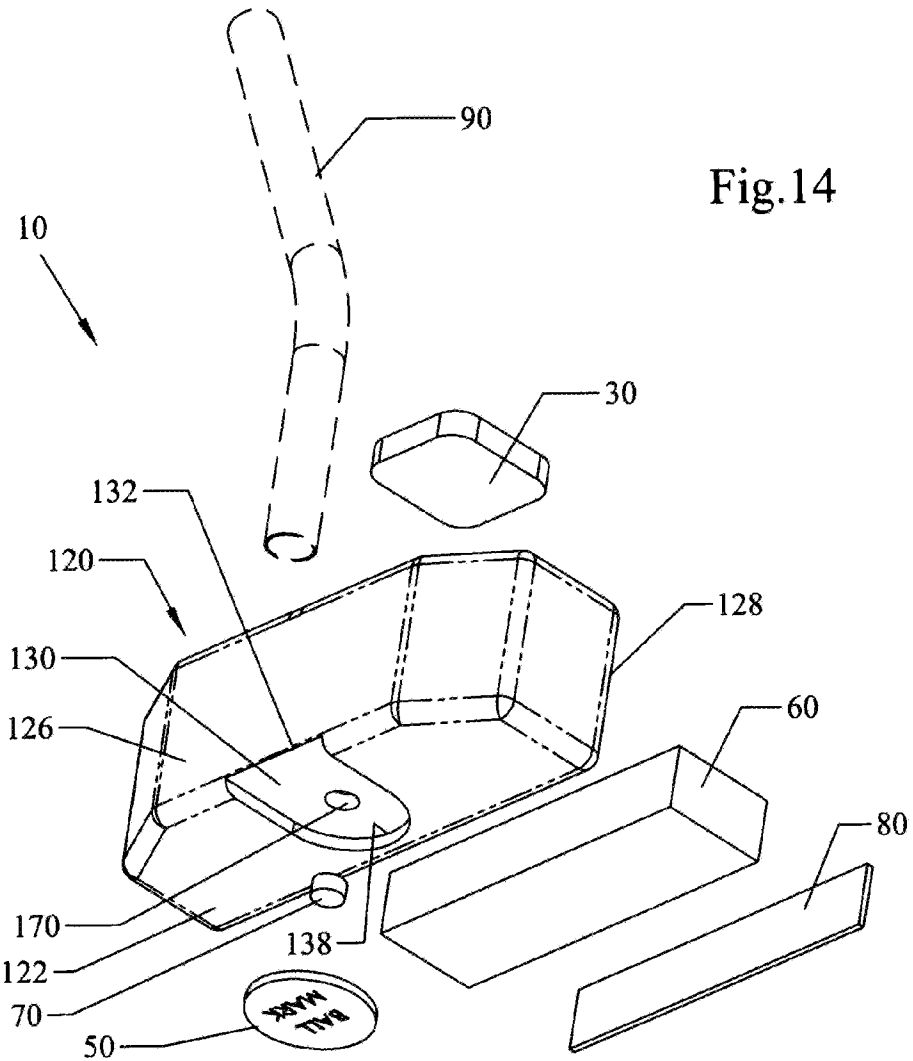
FIG. 14 is a bottom rear exploded perspective view of the putter head of FIG. 1.

FIG. 1 is a top front perspective view of the novel putter head 10. FIG. 2 is a top rear perspective view of the putter head 10 of FIG. 1. FIG. 3 is a bottom front perspective view of the putter head 10 of FIG. 1. FIG. 4 is a bottom rear perspective view of the putter head 10 of FIG. 1. FIG. 5 is a bottom rear perspective view of the putter head 10 of FIG. 1 with ball marker 50 removed. FIG. 6 is a front side view of the putter head 10 of FIG. 1. FIG. 7 is a rear side view of the putter head 10 of FIG. 1. FIG. 8 is a right side view of the putter head 10 of FIG. 1. FIG. 9 is a left side view of the putter head 10 of FIG. 1. FIG. 10 is a top side view of the putter head 10 of FIG. 1. FIG. 11 is a bottom side view of the putter head 10 of FIG. 1 with ball marker in place. FIG. 12 is another bottom view of the putter head 10 of FIG. 11 with ball marker 50 removed. FIG. 13 is a top front exploded perspective view of the putter head 10 of FIG. 1. FIG. 14 is a bottom rear exploded perspective view of the putter head 10 of FIG. 1.

Referring to FIGS. 1-14, the novel putter 10 includes a putter head 20 that can have a putter shaft 90 protruding from a hole 180, where the hole can located off to one side of the head 20. The putter head 20 can include an easily retrievable and storable ball marker 50, and removable portions such as a front face 80 and top removable portion 30 for allowing advertising indicia, logos, and the like, to be placed thereon.

For storing the ball marker 50, a cavity type compartment 130 that can have an oblong shape can be located in the bottom 120 of the putter head 20. The cavity 130 can have an opening groove-shaped cut-out in the lower part of the rear (back) 126 of the putter head 120, and the cavity 130 can have closed sidewalls 138. The entire lower surface of the cavity 130 can be completely open. The cavity 130 can be located so that the marker 50 is substantially located under the main center of mass(center of gravity) of the putter head 120, so that leaving the marker 50 during play does not offset the balance of the putter head 120. A permanent magnet 170 can be located in an indentation in the ceiling surface of the cavity 130.

The player can slide the marker 50 through the side opening 132 until the marker 50 is resting against the inner curved sidewalls of the cavity 130 which is also where the full force of the magnet 170 can then hold the marker 50, such as a metal ball marker in place. Alternatively, the player can position the marker over the main part of the cavity 130 so that the attraction force of the magnet 70 just pulls the marker 50 in place.

When the player needs the ball marker 50, the player can take their finger, such as a thumb and slide the ball marker 50 out of cavity 130 toward the opening 132 until the attraction of the magnet is no longer in effect.

The putter head 120 can also have an upper cavity type compartment 150 that can be used to support a logo plate 30, such as a square logo plate therein, so that advertising indicia is visible from above the putter head 120. The upper logo plate 30 can also be metal, and can be removably held in place by an optional magnet 155. Additionally, the logo plate 30 can have other indicia such as names and addresses of the owner of the putter personalized thereon.

Across the front face 128 of the putter head 120 can be another advertising/logo plate 80. Inside of the putter head 120 can be another compartment 140 that supports a weight 60 such as a lead weight therein. The weight 60 can be removable if the player desires different weights to be used with the putter head 120. Across the front outer face of the weight 60 can be the second advertising metal plate 80 that can also be held in place by an optional magnet 65 that can be attached on the outer face of the weight. The magnet 65 can allow for different logo plates 80 to be removably attached thereon.

Although magnets are described that can hold the logo plate 30 and advertising plate 80, thereon, other types of fastening arrangements can be used. For more permanent attachments, glue or adhesive can be used.

On top of the putter head 120 can a sight line 100 substantially down the middle between the front face 128 and rear face 126 of the putter head 120.

Slidable Marker Field by Tracks

Figure 16:
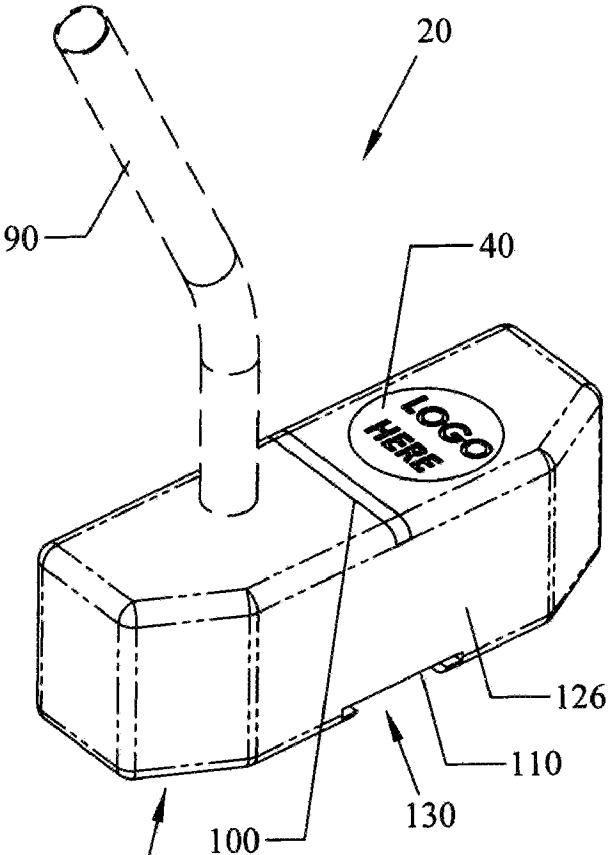
FIG. 16 is a top rear perspective view of the putter head of FIG. 15.
Figure 15:
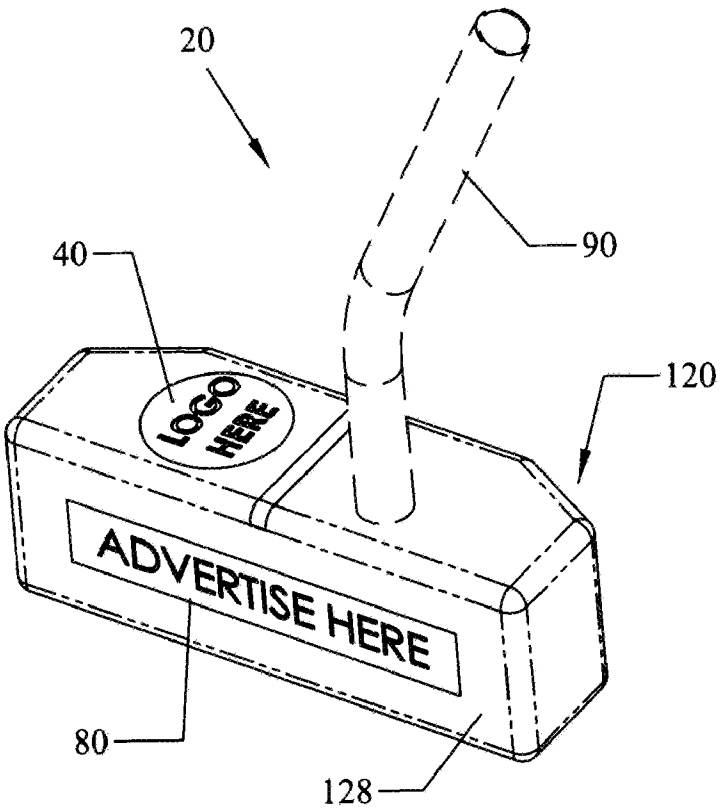
FIG. 15 is a top front perspective view of another embodiment of the novel putter head
Figure 18:
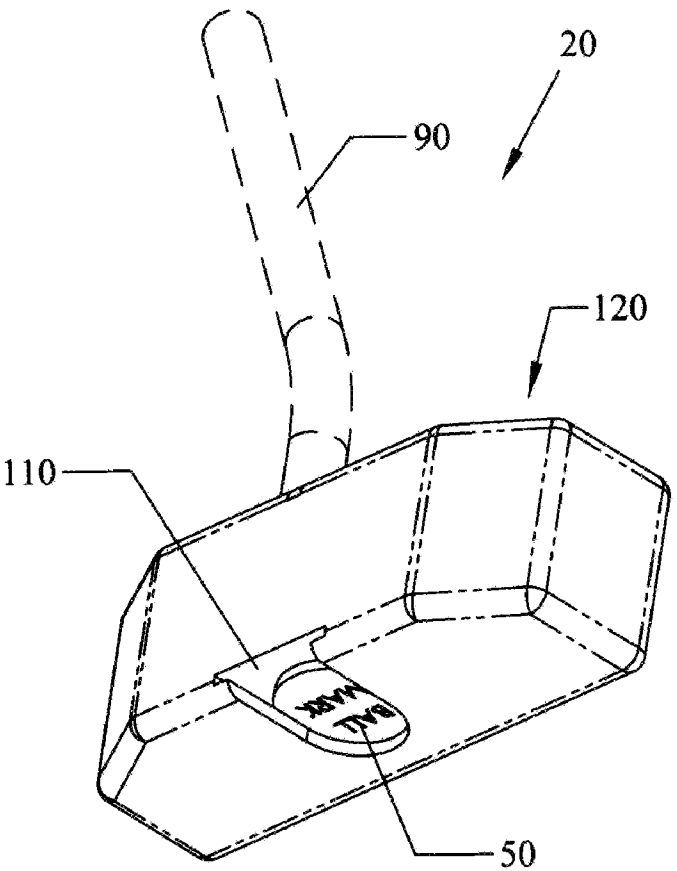
FIG. 18 is a bottom rear perspective view of the putter head of FIG. 1.
Figure 17:
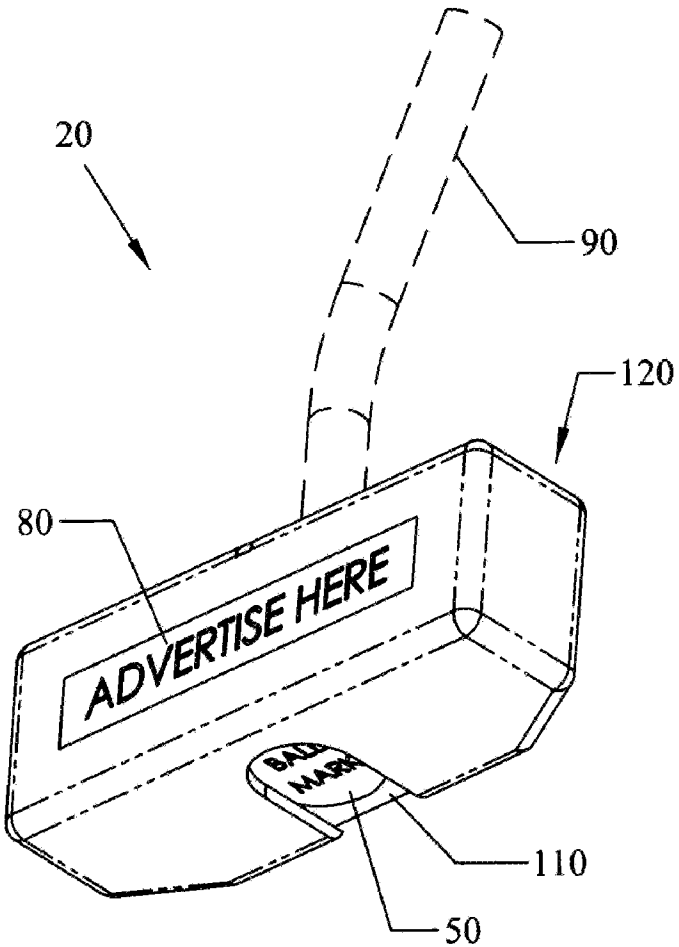
FIG. 17 is a bottom front perspective view of the putter head of FIG. 1.
Figure 19:
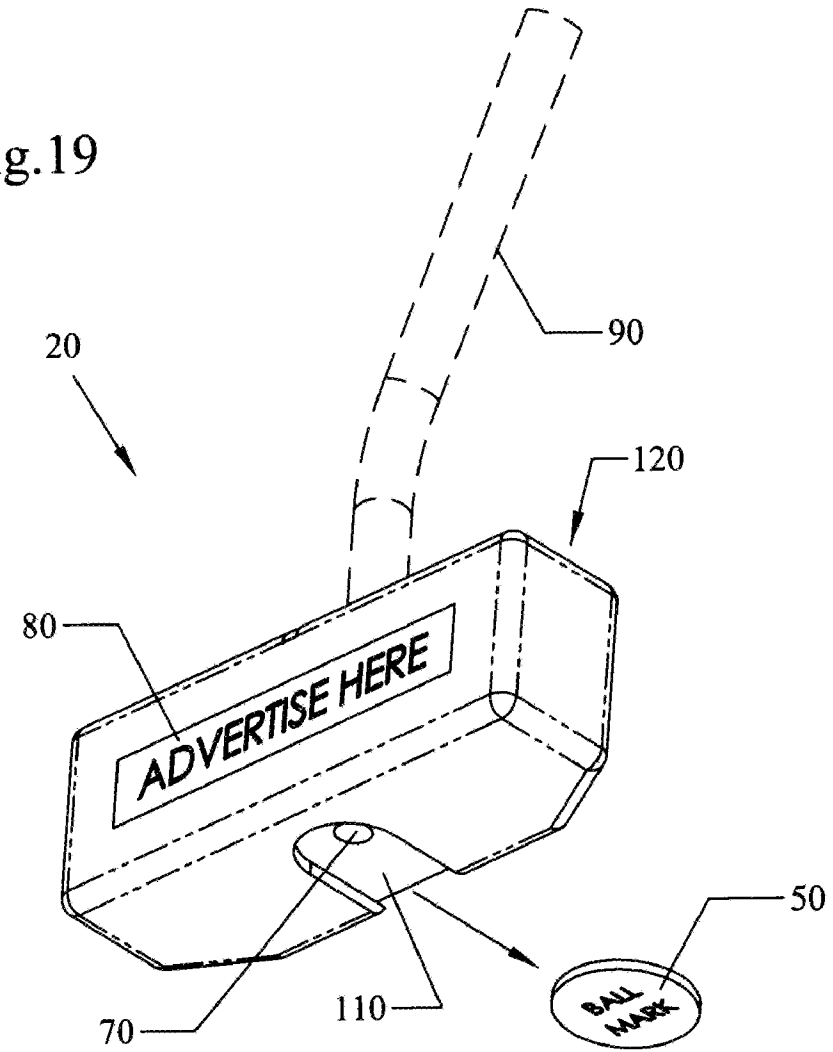
FIG. 19 is a bottom front perspective view of putter head with ball marker removed.
Figure 21A:
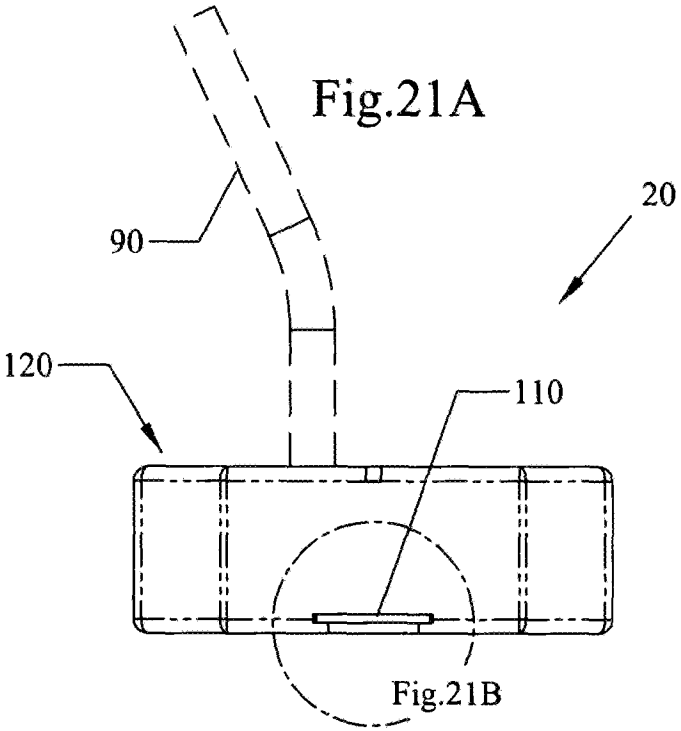
FIG. 21A is a rear view of the putter head with detail of T-Slot ball marker holder.
Figure 20:
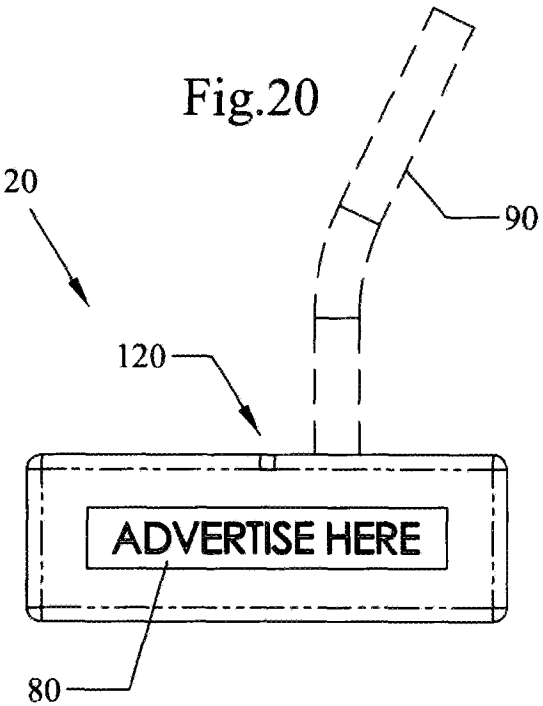
FIG. 20 is a front view of the putter head of FIG. 15.
Figure 21B:
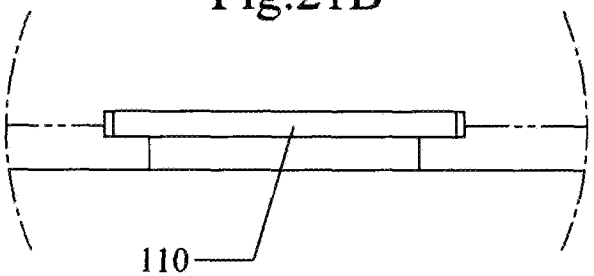
FIG. 21B is an enlarged view of the T-slot ball marker holder compartment of FIG. 21A.
Figure 23:
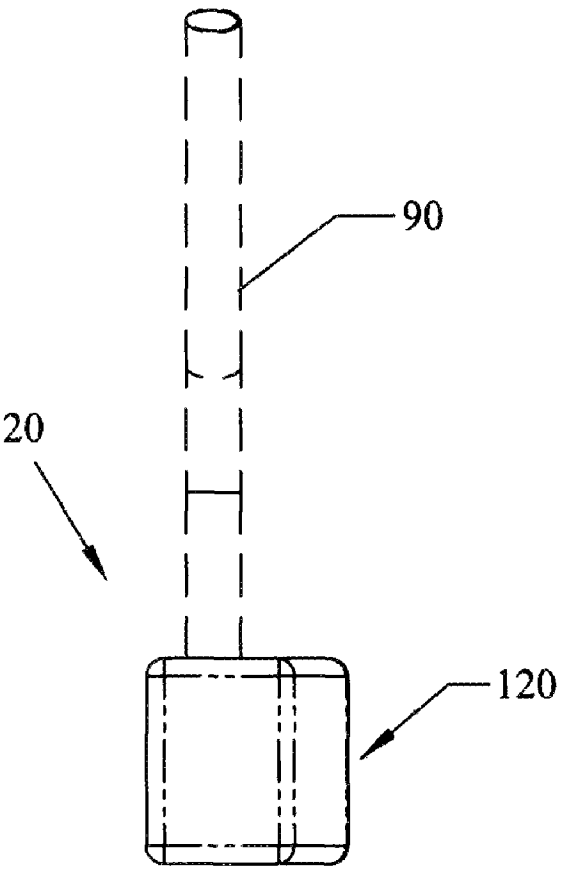
FIG. 23 is a right side view of the putter head of FIG. 15
Figure 22:
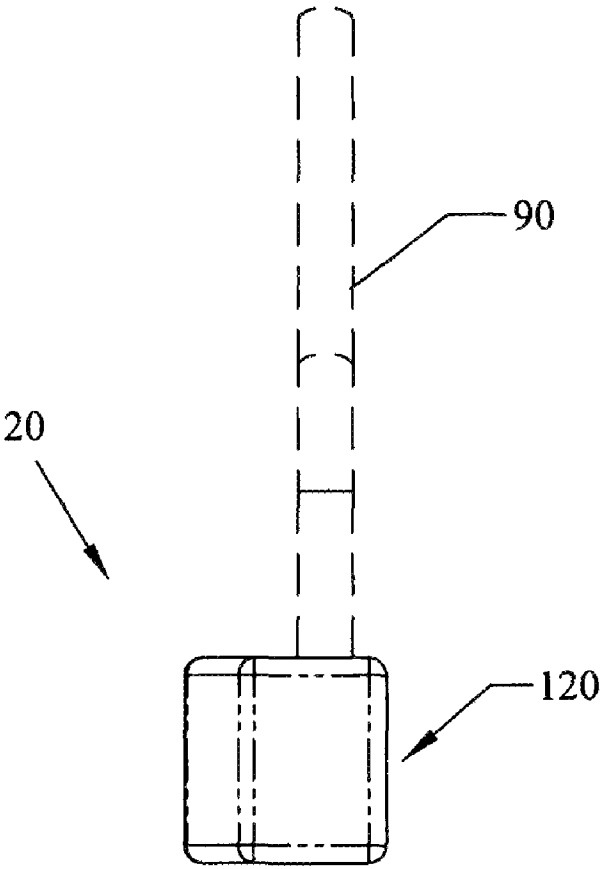
FIG. 22 is a left side view of the putter head of FIG. 15.
Figure 24:
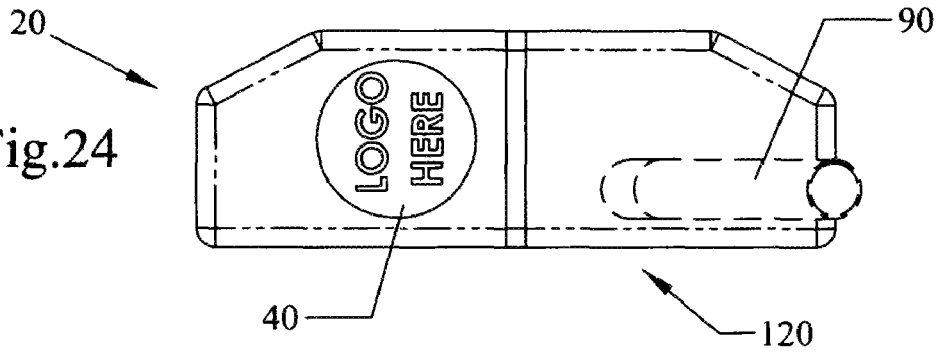
FIG. 24 is a top view of the putter head of FIG. 15.
Figure 25:
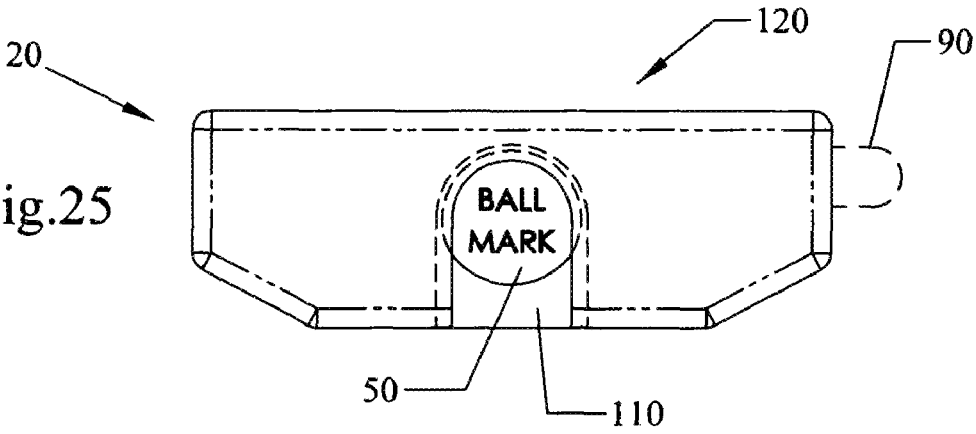
FIG. 25 is a bottom view of the putter head of FIG. 15 with ball marker in T-Slot holder.
Figure 26:
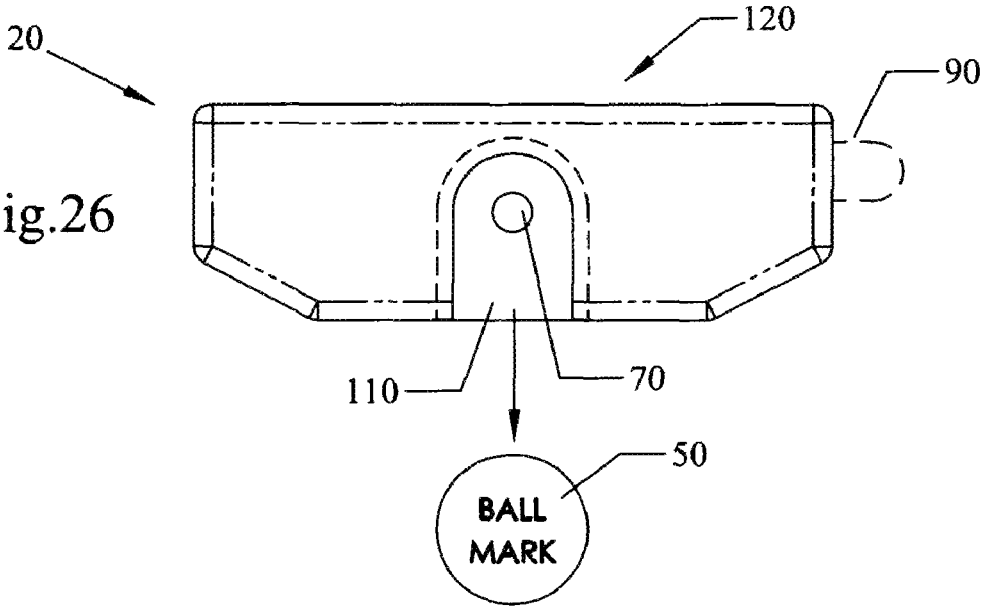
FIG. 26 is a bottom view of the putter head of FIG. 25 with ball marker removed from T-Slot holder.
Figure 27:
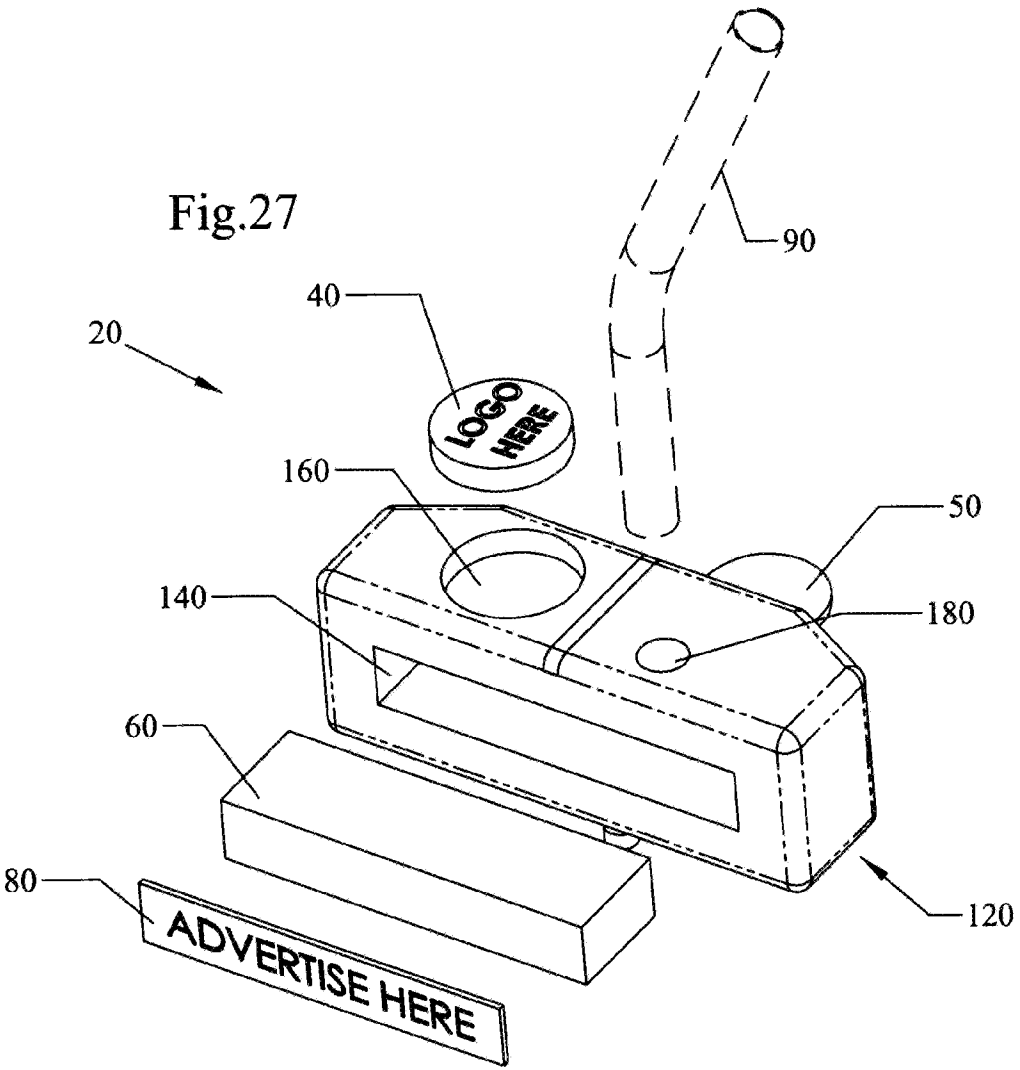
FIG. 27 is a top front exploded view of the putter head of FIG. 15.
Figure 28:
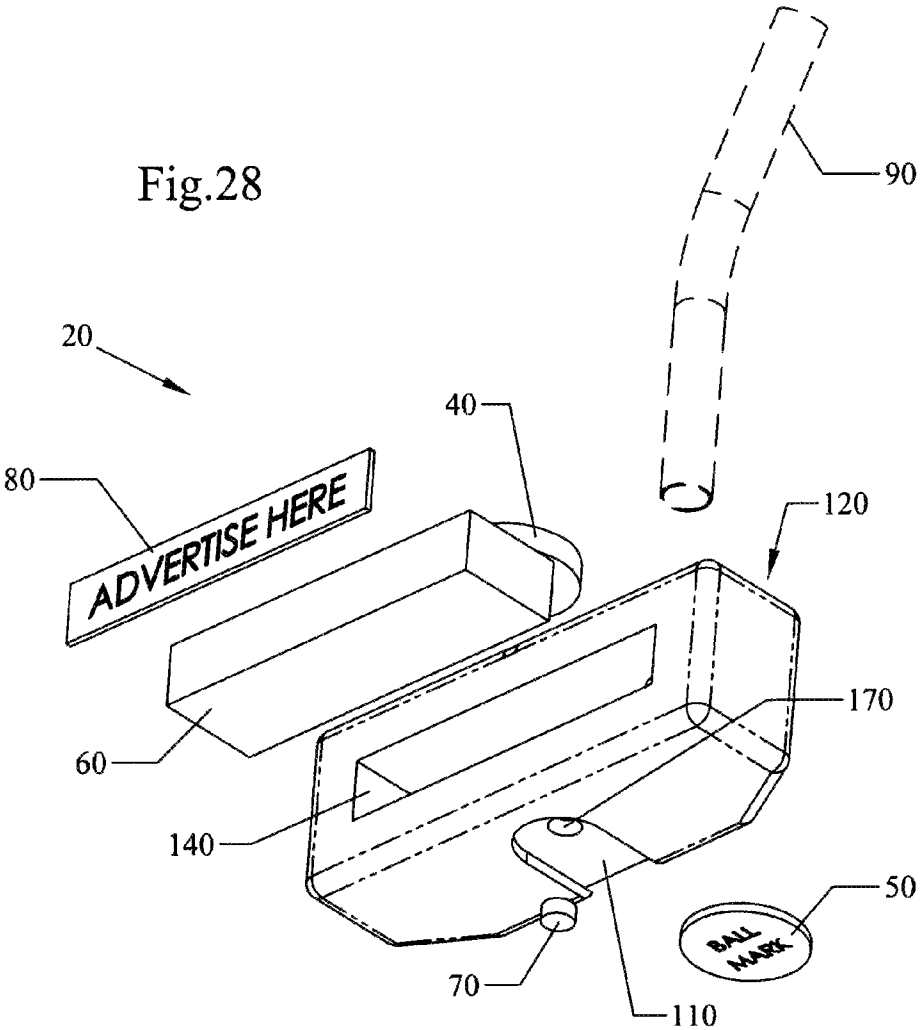
FIG. 28 is a bottom front exploded view of the putter head of FIG. 15.

FIG. 15 is a top front perspective view of another embodiment of the novel putter head 20. FIG. 16 is a top rear perspective view of the putter head 20 of FIG. 15. FIG. 17 is a bottom front perspective view of the putter head 20 of FIG. 1. FIG. 18 is a bottom rear perspective view of the putter head 20 of FIG. 1 FIG. 19 is a bottom front perspective view of putter head 20 with ball marker 50 removed. FIG. 20 is a front view of the putter head 20 of FIG. 15. FIG. 21A is a rear view of the putter head with detail of T-Slot ball marker holder compartment 110. FIG. 21B is an enlarged view of the T-slot ball marker holder compartment 110 of FIG. 21A. FIG. 22 is a left side view of the putter head 20 of FIG. 15. FIG. 23 is a right side view of the putter head 20 of FIG. 15 FIG. 24 is a top view of the putter head 20 of FIG. 15. FIG. 25 is a bottom view of the putter head of FIG. 15 with ball marker 50 in T-Slot holder compartment 110. FIG. 26 is a bottom view of the putter head 20 of FIG. 25 with ball marker 50 removed from T-Slot holder. FIG. 27 is a top front exploded view of the putter head 20 of FIG. 15. FIG. 28 is a bottom front exploded view of the putter head 20 of FIG. 15.

Referring to FIGS. 15-28, the second embodiment can include similar parts as in the previous embodiment with the exception of utilizing a disc shaped logo plate 40 that can also be held in place by a magnet in side of the cavity 160 of the supporting the disc shaped plate 40 therein. In addition, the second embodiment 20 can have a T-slot shaped cavity type compartment 110 that can have track shaped edges that can grip about side edges of the ball marker 50. Although a preferred ball marker 50 can be metal, the T-shot shaped tracks can be sized tight enough so that the edges of nonmetal (such as plastic) ball markers, can be held in place. Also, a magnet 70 can be used with the T-slot shaped cavity compartment in order to more carefully secure the ball marker 50 in place. With the T-slot shaped cavity, the user generally must slide the marker into the cavity through the lower rear back side opening 132 of the cavity 130. The removal can be similar to the previous embodiment where the user slides the marker out of the cavity toward the opening 132.

Although the preferred embodiments refer to the golf club being a putter, the invention can be used with other types of golf clubs, such as drivers, woods, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A golf club with compartment for holding a ball marker comprising:

a head of a golf club having a flat bottom side, a top side, and a front side, a rear side, a contiguous left side between the front side and the rear side, and a contiguous right side between the front side and the rear side;

a longitudinal U-shaped compartment in the bottom side of the golf club head, the compartment having an opening through the rear side of the head next to the bottom side, and the compartment having closed side walls with a concave curved front wall, a closed flat upper wall, and a U-shaped opening under the compartment through the bottom side of the golf club head, the closed flat upper wall of the longitudinal U-shaped compartment being parallel to the flat bottom side of the golf club head;

track slots along both of the side walls of the compartment extending from the opening in the rear side of the head to the curved front wall of the compartment;

a first magnet mounted in the upper wall of the U-shaped compartment, the magnet being closer to the concave curved front wall than to the opening to the compartment; and a disc shaped metal ball marker that is slid into and out of the opening in the rear side of the club head into the compartment by the track slots, so that the ball marker is held within the compartment by both the first magnet and track slots; an opening in at least one side of the head having a second magnet for attaching a removable indicia plate to the opening.

2. The golf club of claim 1, wherein the golf club is a putter.

3. The golf club of claim 1, further comprising:

a removable circular disc as the plate having an upper surface for the indicia.

4. The golf club of claim 1, further comprising:

a removable rectangular plate having an upper surface for the indicia.

5. A golf putter, comprising:

a head having a flat bottom side, a top side, and a front side, a rear side, a contiguous left side wall between the front side and the rear side, and a contiguous right side wall between the front side and the rear side;

a longitudinal U-shaped cavity in the bottom side of the head, the cavity having a opening through the rear side of the head next to the bottom side, and the cavity having closed side walls, a curved front wall, a closed upper flat wall, and an opening under the cavity through the bottom side of the head, the closed upper flat wall of the U-shaped cavity being parallel to the flat bottom side of the head;

a first magnet mounted in the upper wall of the U-shaped cavity, the magnet being closer to the curved front wall than to the opening to the U-shaped cavity;

track slots along both of the side walls of the cavity extending from the opening in the rear side of the head to the curved front wall of the cavity; and a disc shaped metal ball marker slidable into and out of the opening in the rear side of the head into the cavity, wherein the track slots along the side walls of the cavity allow edges of the marker to slide therein, so that the ball marker is held within the cavity by the first magnet and the track slots; and an opening on at least one side of the head having a second magnet for attaching a removable indicia plate.

6. The golf putter of claim 5, wherein each of the track slots includes:

a T-shaped slot in the cavity for allowing edges of the marker to slide therein by friction between the edges of the marker and the track slots in the side walls of the cavity.

7. The golf club of claim 1, wherein the side walls of the U-shaped compartment/cavity are straight and parallel to one another, and that the opening through the rear side of the head to the compartment is in the middle of the rear side of the head.

8. The golf club of claim 5, wherein the side walls of the U-shaped cavity are straight and parallel to one another, and that the opening through the rear side of the head to the cavity is in the middle of the rear side of the head.

9. The golf club of claim 1, wherein each of the track slots includes:

a T-shaped slot in the cavity for allowing edges of the marker to slide therein by friction between the edges of the marker and the track slots in the side walls of the cavity.

10. The golf club of claim 1, wherein the magnet is fixably mounted in an indentation in the closed flat upper wall of the compartment under a main center of gravity of the head, and the edges of the marker being underneath portions of both sides of the track slots and against the concave curved front wall in a lock position is located under the main center of gravity of the head, so that leaving the marker in the lock position in the compartment during play does not offset balance of the head of the golf putter.

11. The golf putter of claim 5, wherein the first magnet is fixably mounted in an indentation in the closed flat upper wall of the cavity under a main center of gravity of the head, and the edges of the marker being underneath portions of both sides of the track slots and against the concave curved front wall in a lock position is located under the main center of gravity of the head, so that leaving the marker in the lock position in the cavity during play does not offset balance of the head of the golf putter.

* * * * *